US007143537B2

(12) United States Patent
Stone

(10) Patent No.: US 7,143,537 B2
(45) Date of Patent: Dec. 5, 2006

(54) FIRING PIN ASSEMBLY

(75) Inventor: Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 0 days.

(21) Appl. No.: 10/752,909

(22) Filed: Jan. 7, 2004

(65) Prior Publication Data

US 2006/0112604 A1 Jun. 1, 2006

Related U.S. Application Data

(60) Provisional application No. 60/523,468, filed on Nov. 19, 2003.

(51) Int. Cl.
*F41A 19/13* (2006.01)

(52) U.S. Cl. ..... 42/69.01

(58) Field of Classification Search ..... 42/69.01, 42/69.02, 69.03

See application file for complete search history.

(56) References Cited

U.S. PATENT DOCUMENTS

| | | | | | |
|---|---|---|---|---|---|
| 1,313,912 | A | * | 8/1919 | Reising | 42/69.02 |
| 1,358,104 | A | | 11/1920 | Payne | |
| 2,089,581 | A | * | 8/1937 | Sedgley | 42/70.08 |
| 2,099,035 | A | * | 11/1937 | Rowley | 42/16 |
| 2,950,653 | A | * | 8/1960 | Harvey | 89/185 |
| 3,050,894 | A | * | 8/1962 | Ivy | 42/69.01 |
| 3,411,405 | A | | 11/1968 | Pachmayr et al. | 89/196 |
| 3,645,166 | A | * | 2/1972 | Plumer et al. | 89/26 |
| 4,462,179 | A | | 7/1984 | Rogak et al. | 42/1 Q |
| 4,575,962 | A | | 3/1986 | Rogak et al. | 42/1 Q |
| 4,791,748 | A | | 12/1988 | Leskinen | 42/75.02 |
| 4,891,898 | A | | 1/1990 | Houseman | 42/69.02 |
| 5,388,361 | A | * | 2/1995 | Farr | 42/1.16 |
| 6,000,161 | A | | 12/1999 | Aalto | 42/16 |
| 6,061,944 | A | | 5/2000 | Schroeder | 42/16 |
| 6,634,129 | B1 | | 10/2003 | Freeman, Jr. | |

FOREIGN PATENT DOCUMENTS

| | | |
|---|---|---|
| DE | 164 940 A | 11/1905 |
| DE | 91 05 338UA | 7/1991 |

* cited by examiner

*Primary Examiner*—Stephen M. Johnson
(74) *Attorney, Agent, or Firm*—Womble Carlyle Sandridge & Rice, PLLC

(57) ABSTRACT

A firing pin assembly is provided that includes a firing pin and a firing pin shaft. The firing pin is received in a slot of the end of the firing pin shaft to be retained therein with a spring retaining sleeve, a main spring, and a main spring sleeve. The firing pin is removable from the firing pin assembly and can be replaced to result in a prolonged use of the firing pin assembly. The firing pin assembly will operate as a one-piece unit when the spring retaining sleeve is oriented to hold the components securely in place.

12 Claims, 4 Drawing Sheets

FIRING PIN ASSEMBLY

This application claims priority of provisional U.S. Patent Application 60/523,468, filed on Nov. 19, 2003.

FIELD OF THE INVENTION

The present invention relates generally to a two-piece floating construction for a firing pin assembly and a method of replacing the firing pin of the assembly.

BACKGROUND OF THE INVENTION

Firearms such as pistols and rifles typically utilize a firing pin assembly including a firing pin that is engaged, such as by a hammer, upon a trigger pull and to strike the primer of a round of ammunition to initiate ignition of the round. Given the mechanical operation of the firing pin being struck and striking the round of ammunition, the repeated use of the firing pin assembly can cause fatigue of the firing pin and/or can result in improper wear of the firing pin, especially if the firearm is not properly maintained. As a result, the firing pin can become worn or possibly damaged, which can result in misfiring.

In such a situation where the firing pin has become worn or damaged, the typical solution to address this problem has been to replace the entire firing pin assembly. However, replacement of the complete firing pin assembly can be cumbersome, prone to inaccuracy, and expensive.

SUMMARY OF THE INVENTION

In accordance with the present disclosure, the present invention generally is directed to a two-piece, floating firing pin assembly for firearms and methods for constructing such firing pin assembly and for replacing the firing pin of the assembly is provided. The firing pin assembly generally is comprised of a series of individual components that can be manufactured as separate components or pieces that are substantially interchangeable and can be assembled together to create a completed firing pin assembly. The completed firing pin assembly will act as a one-piece, unitary firing pin structure to strike and initiate firing of a round of ammunition when the firearm is actuated in use. Additionally, the assembled firing pin assembly allows for the individual pieces, such as the firing pin, of the firing pin assembly to be quickly and easily replaced as needed or desired, without requiring replacement of the entire firing pin assembly.

The firing pin assembly described herein generally includes two-piece construction including a firing pin having a forward, distal or striking end and a rear, proximal end or head. The firing pin head is received within a recess or receiving slot of a firing pin shaft to form the two-piece firing pin construction. A main spring sleeve further is initially placed on a firing pin shaft to seat the firing pin head within a notch thereof and a main spring is slid over the firing pin and onto the firing pin shaft to rest against the circumferential forward surface of the main spring sleeve. Thereafter, a spring retaining sleeve is placed over the head of the firing pin received within the slotted end of the firing pin shaft to secure the components together and compress the main spring. In one example embodiment, an audible click may issue as the spring sets the spring retaining sleeve against the notch of the firing pin shaft.

In order to replace the firing pin of the assembled firing pin assembly, the spring retaining sleeve initially is removed to release the main spring and enable the firing pin to be removed from the firing pin shaft. The firing pin then can quickly and easily be replaced and the firing pin assembly reassembled.

As an additional feature, the firing pin shaft can accept a floating firing pin. The interface between the firing pin shaft and the firing pin allows for relative motion of the firing pin in view of the assembled length of the firing pin assembly. Accordingly, to overcome any misalignment situations, the firing pin and the firing pin shaft can be allowed to float or move slightly as needed. This floating prevents buckling, binding, or breaking of the firing pin and adds robustness to the design of the firing pin assembly. By allowing the firing pin to float within the firing pin shaft, the geometry of the firing pin can be changed without changing the interface between the firing pin shaft and the hammer of the firearm to potentially allow, for example, for the production of rim-fire firing pins and center-fire firing pins. The completed firing pin assembly described herein thus emulates the function and operation of a one-piece firing pin, by the coupling of the firing pin and firing pin shaft to allow the firing pin assembly to act as a one-piece firing pin when firing the gun.

Various features, objects, and advantages of the present firing pin assembly are discussed in, or will become apparent from, the detailed description set forth below.

DESCRIPTION OF THE PREFERRED EMBODIMENT

Figure 1:
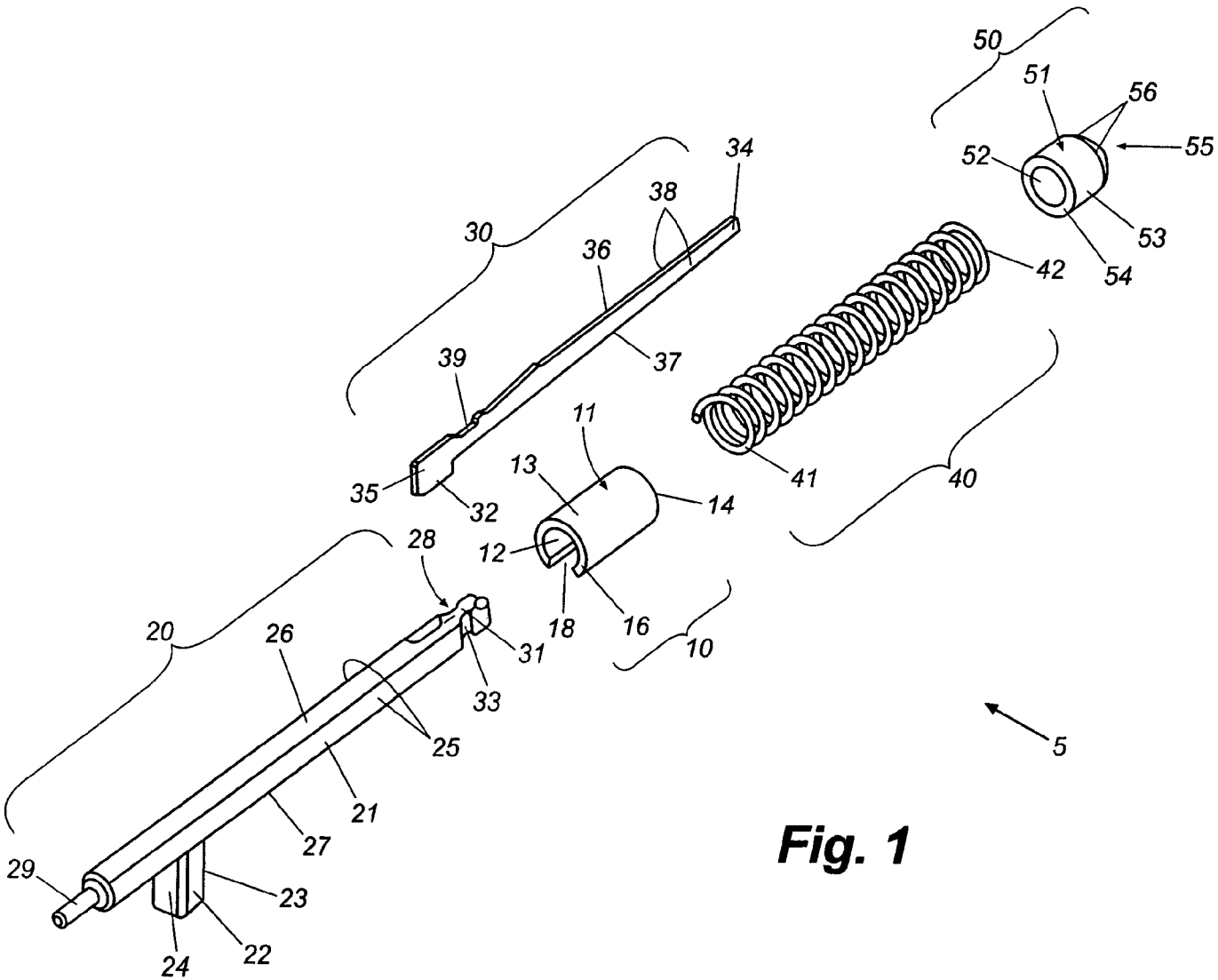
FIG. 1 is an exploded perspective view of the two-piece firing pin assembly.

Reference is now made in more detail to the drawing figures, wherein like numerals refer, where appropriate, to like parts throughout. FIG. 1 is an exploded perspective view of the firing pin assembly of the present invention. The firing pin assembly 5 generally includes five major components, including a main spring sleeve 10, firing pin shaft 20, firing pin 30, main spring 40, and a spring retaining sleeve 50.

As shown in FIG. 1, the main spring sleeve 10 has a cylindrical side wall 11 having an inner surface 12 and an outer cylindrical surface 13. The main spring sleeve 10 further is typically formed of a metal or metal alloy, although other, resilient, durable materials also can be used, with the main spring sleeve being resilient enough to withstand pressure by the main spring 40 while engaged with the firing pin shaft 20. The main spring is configured to maintain a precise distance between the main spring sleeve 10 and the spring retaining sleeve 50. The main spring sleeve 10 also includes a first or proximal end 14 having a circumferential surface, which is typically oriented in an installed position in the assembled firing pin assembly 5 facing toward the firing pin 30, and a second, distal notched end 16 having a surface that is typically oriented, when in an installed position in the firing pin assembly, facing away from the firing pin 30. A notch 18 is formed in the side wall 11 of the main spring sleeve and extends from the notched end 16 toward, but generally not extending fully through, the circumferential surface 14. The notch 18 extends through the cylindrical side wall of the main spring sleeve 10 and can be configured to receive and engage a firing pin shaft head 22 of the firing pin shaft 20.

Figure 2:
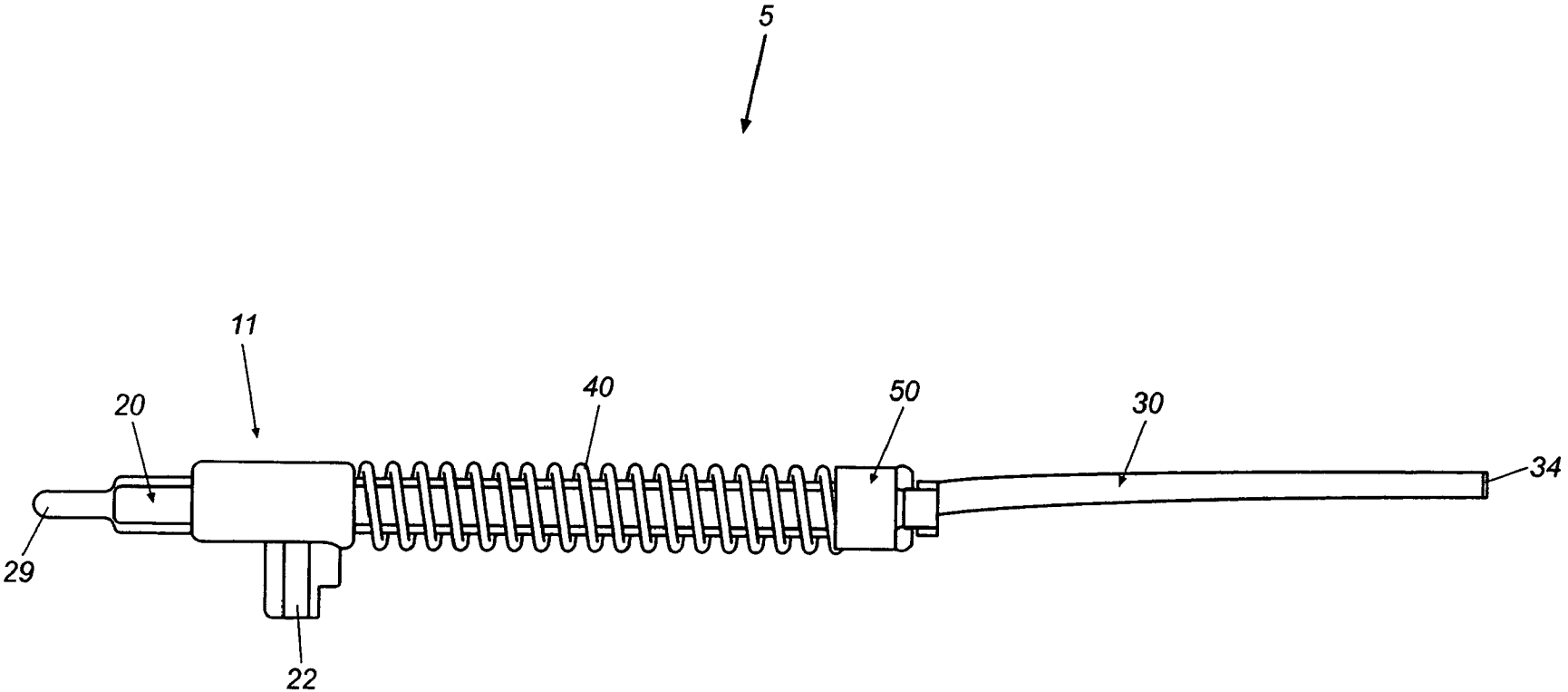
FIG. 2 is a complete firing pin assembly.

As indicated in FIGS. 1 and 2, the firing pin shaft 20 of the firing pin assembly 5 is an elongated member generally formed from a metal, such as steel, or a metal alloy, though other rigid high strength durable materials such as synthetic or composite materials also can be used. The firing pin shaft 20 has a body 21 that typically is rectangular with a firing pin shaft top surface 26, side surfaces 25, and a bottom surface 27, although other shapes or configurations also can be used. The bottom surface 27 of the firing pin shaft 20 typically houses a firing pin shaft head portion or projection 22 that extends downwardly therefrom. The firing pin shaft head 22 has a front surface 23 and a back surface 24, with the front surface 23 being adapted to engage the main spring sleeve 10 when the components of the firing pin assembly are assembled into an operative configuration. The firing pin shaft 20 further has a first or forward, notched end 28 and a second or rear, unnotched end 29. As can be seen in FIG. 1, the firing pin shaft head 22 is typically disposed near the unnotched end 29, spaced longitudinally from the notched end 28.

The notched end 28 of the firing pin shaft 20 houses a slot or channel 31 that extends rearwardly from the notched end 28 and is adapted to receive a firing pin appendage or head portion 32 of the firing pin 30 therein so as to engage and retain the firing pin in a locked, unitary configuration as described below and as illustrated in FIG. 1. Retaining surfaces 33 are spaced inwardly from the notched end 28 and project perpendicular to the slot 31. The retaining surfaces 33 typically include or comprise indentations or recesses formed in the side walls 25 of the firing pin shaft 20 adjacent its notched end 25 that are engaged by the spring retaining sleeve 50 as it is positioned over the notched end 28 of the firing pin shaft and the head 32 of the firing pin 30.

The firing pin 30 is an elongated member or piece, generally formed from a metal or alloy such as steel, although other rigid, durable, high-strength materials including synthetic or composite materials also can be used. Together, the firing pin and firing pin shaft form a two-piece floating or adjustable construction for the firing pin assembly 5. The firing pin, as well as the firing pin shaft, further generally can be formed by stamping, cutting, metal injection molding or other low cost forming methods by which the parts can be quickly and easily produced with a wider range of tolerances without requiring extensive and precise finishing of the parts so as to enable ease of replacement as needed at a later time.

Figure 4A:
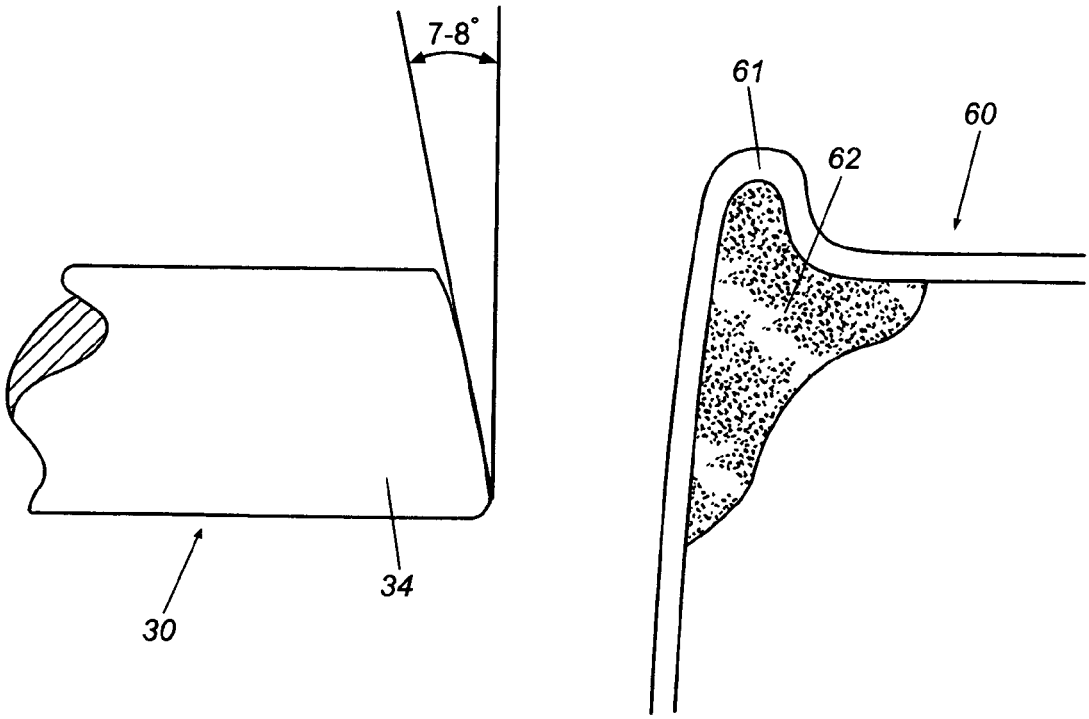
FIGS. 4*a* and 4*b* are enlarged views of the firing pin and a shell before and at impact.
Figure 4B:
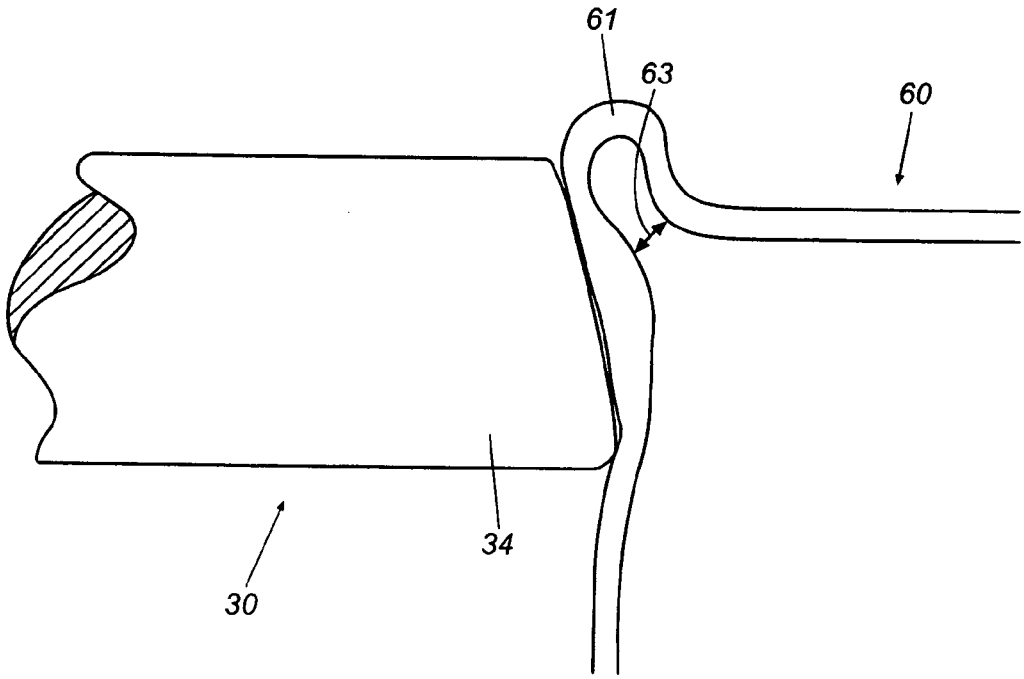

As illustrated in FIGS. 1 and 2, the firing pin 30 has a top edge 36, a bottom edge 37, flat faces or sides 38, retention end 35, head portion 32, and a firing end or tip 34. The tip 34 of the firing pin typically is of a smaller dimension than the retention end 35 and will be formed and/or finished similar to conventional firing pins, such as including a ceramic or similar material coating thereover. In one embodiment, the tip 34 of the firing pin 30 also includes a 7-8° angled surface as shown in FIGS. 4*a* and 4*b*. The purpose/theory of the angled surface is to trap primer mix in the rim of a rim fire cartridge to lessen the rate of misfire. The head portion 32 of the firing pin is an enlarged, flattened section as shown in FIG. 1 that typically projects below the firing pin bottom edge 37 and defines a flange or a male portion adapted to be received by the firing pin shaft 20 within the slot 31. The firing pin top edge 36 further will include a retaining surface or notch 39 that corresponds to, and becomes substantially aligned with, the retaining surfaces 33 of the firing pin shaft 20 as described above when the firing pin and the firing pin shaft are linked together for receiving and engaging the spring retaining sleeve 50 when the firing pin assembly 5 is assembled.

The main spring 40 generally is a compression spring that is received over and extends along the firing pin shaft 20 and engages the main spring sleeve 10 at a first end 41 and the spring retaining sleeve 50 at its other, second end 42 when the firing pin assembly is assembled. When assembled, the main spring 40 is engaged to place the entire firing pin assembly 5 in compression to secure the components together in a compression fitting arrangement so that the firing pin assembly 5 functions as a substantially unitary structure and resists twisting or undesired shifting movements. It should be noted that although the main spring 40 is shown in the figures with its first end 41 engaging the main spring sleeve 10 and end 42 engaging the spring retaining sleeve 50, one of ordinary skill will recognize that the main spring 40 is capable of being assembled so that its second end 42 engages the main spring sleeve 10 and its first end 41 engages spring retaining sleeve 50 without any loss of function. Thus, the ends of the spring are shown in the orientation of FIG. 1 for ease of description and should not limit the firing pin assembly to the particular main spring orientation shown. The main spring 40 further is typically comprised of metal or a metallic alloy, but also could be formed of any resilient, durable material, including synthetic or composite materials, that will provide the needed compression force/resistance for retention of the firing pin assembly. The main spring 40 also typically is "pre-stressed" to ensure no "set" in normal operation.

As further illustrated in FIGS. 1 and 2, the spring retaining sleeve 50 of the firing pin assembly 5 described herein is typically formed as a cylinder from a metal, metal alloy, synthetic, composite or other durable material, with a cylindrical side wall 51 having an inner surface 52 and an outer surface 53 and defining a passage through which the firing pin 30 is received. The spring retaining sleeve 50 has a first, forward slotted end 55 having a slot and a circumferential rear or second end 54, with the circumferential end typically engaging the main spring 40 when the firing pin assembly is assembled. The slot formed in the slotted end 55 further includes side surfaces 56 that are adapted to engage the retaining surfaces 33 of the firing pin shaft 20 and the retaining surface 39 of the firing pin 30 when the firing pin assembly is assembled.

Figure 3:
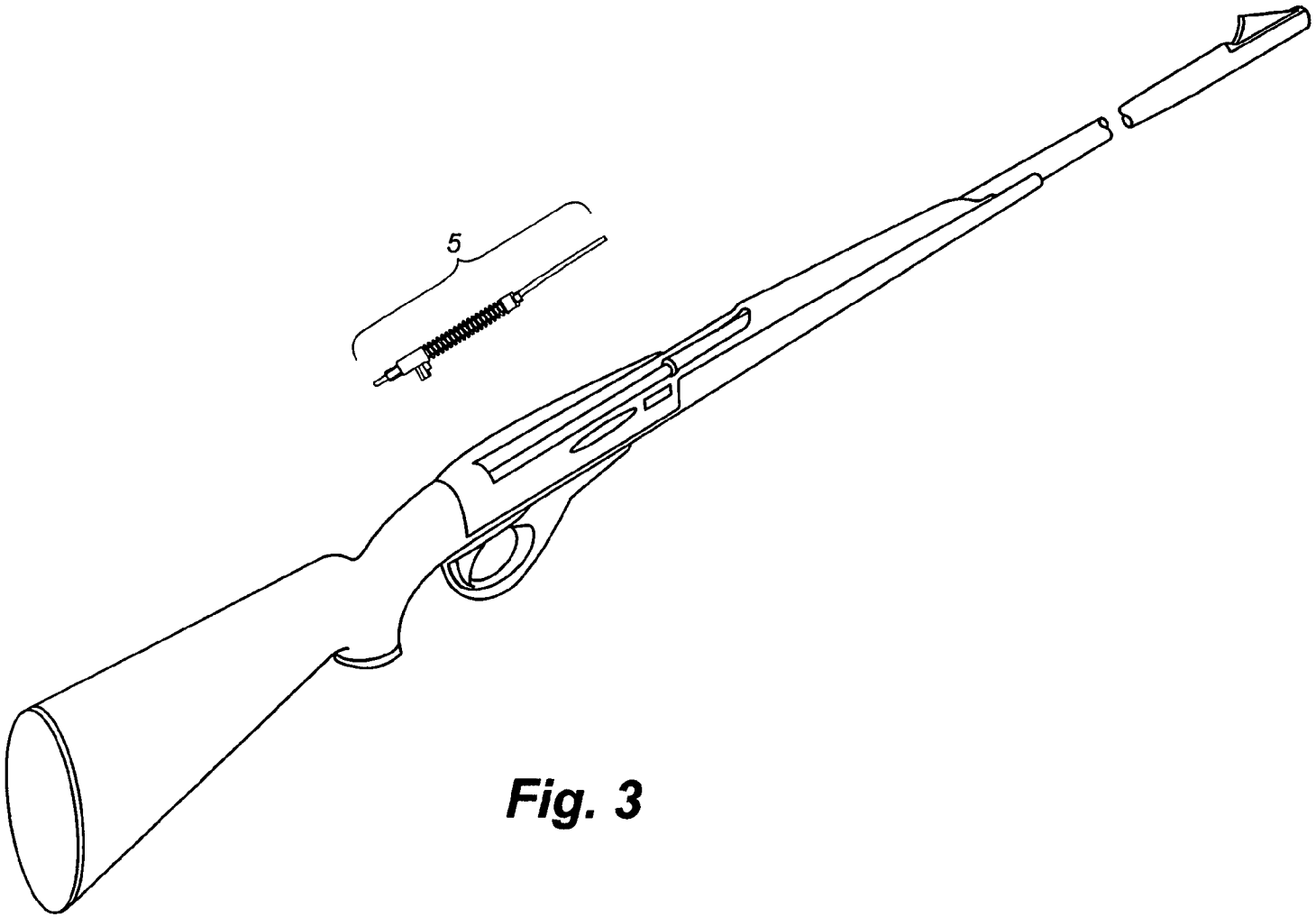
FIG. 3 is a side elevational view of the firing pin assembly for use in a firearm.

FIGS. 2 and 3 show the completed firing pin assembly and its use in a firearm F (FIG. 3) such as a rifle, although it will be understood that the firing pin assembly of the present invention also can be used in various other types of firearms such as shotguns and other long guns and larger firearms as well as handguns. When completed, main spring sleeve 10 of the firing pin assembly is engaged with the firing pin shaft 20 and the firing pin 30 engaged in the slot 31 and held in compression by the engagement of the main spring 40 between the firing pin head 22 at one end and the spring retaining sleeve 50 at the other.

The method of assembling the firing pin assembly will now be described. First, the main spring sleeve 10 is slid onto the firing pin shaft 20. The notched end surface of the main spring sleeve 10 is initially slid over the notched end 28 of the firing pin shaft 20 with the notch 18 of the main spring sleeve 10 being aligned longitudinally with the bottom surface 27 of the firing pin shaft 20. The main spring sleeve 10 is then slid rearwardly onto the firing pin shaft 20 with the notch 18 engaging the firing pin shaft head 22. The main spring sleeve 10 is then moved along the firing pin shaft 20 until the firing pin head 22 of the firing pin shaft 20 becomes seated within the notch of the main spring sleeve 10 as illustrated in FIG. 2.

Next, with the firing pin shaft 20 generally being held horizontally with its firing pin shaft head 22 pointing in a downwardly extending direction, the head portion 32 of the firing pin 30 is aligned with and inserted into the slot 31 of the notched end 28 of the firing pin shaft 20. The firing pin 30 is then fully inserted or urged into the slot 31 of the firing pin shaft 20 to set nearly flush the top surface 36 of the firing pin 30 with the top surface 26 of the firing pin shaft 20.

Once the firing pin 30 has been seated or nested within the slot of the firing pin shaft 20, the main spring 40 is slid over the firing pin 30, past the notched end 28, and onto the firing pin shaft 20. The main spring 40 is urged along the coupled firing pin 30 and firing pin shaft 20 until it rests against the circumferential surface 14 of the main spring sleeve 10, mounted on the firing pin shaft 20 at the firing pin shaft head 22 as described above. The components generally are then reoriented vertically with the firing pin 30 pointing in an upward direction. The spring retaining sleeve 50 then is placed over the firing pin 30 with its slotted end 55 pointing upwardly and with the side surfaces 56 of the slot arranged parallel to the broad, flat faces 38 of the firing pin 30.

The spring retaining sleeve 50 is then moved downwardly over the firing pin 30 into engagement with the second end 42 of the main spring 40. The main spring 40 is then compressed until the slotted end 55 of the spring retaining sleeve 50 is moved below the notched end 28 of the firing pin shaft 20. While the main spring 40 is maintained in a compressed condition, the spring retaining sleeve 50 is rotated ninety degrees about the retaining surfaces 33 of the firing pin shaft 20 and the retaining surfaces 39 of the firing pin 30 and released. The release of the main spring 40 accordingly urges and sets the spring retaining sleeve 50 against the retaining surfaces 33 of the firing pin shaft 20 and the retaining surface 39 of the firing pin 30. Additionally, an audible "click" may issue as the main spring 40 sets the spring retaining sleeve 50 against the retaining surfaces to indicate to an operator/user that the assembly is completed. The result of the above-described method is the complete firing pin assembly as shown in FIG. 2.

To replace the firing pin 30, should it become worn or broken, such as at the tip thereof, the firing pin assembly is disassembled by first applying pressure to the spring retaining sleeve 50 in a direction toward the main spring 40, and rotating the spring retaining sleeve 50 approximately ninety degrees in a direction opposite the rotation for assembly as noted above, to release the spring retaining sleeve, after which it can be removed from the firing pin assembly. The main spring 40 can then be removed and the firing pin 30 removed from engagement with the slot 31 of the notched end 28 of the firing pin shaft 20. A replacement firing pin can then be replaced within the slot 31 and the firing pin assembly reassembled as detailed above with the replacement firing pin used in place of the worn or damaged firing pin 30. When complete, the replacement firing pin assembly can be reinstalled into a firearm, as indicated in FIG. 3.

The method of assembling the firing pin assembly may be performed by hand and does not require the use of any fixtures, tools, or other implements. Further, alternatively to the method steps as detailed above with respect to the installation of the retaining sleeve 50, the components also could be held in any orientation desired (cf. vertically not required) to install the spring retaining sleeve as long as the side surfaces 25 of the slot 31 formed in the slotted end 28 are oriented parallel to the flat faces 38 of the firing pin 30. The orientation as detailed above is utilized herein for ease of description and should not be limiting in any way. Further, during performance of the method of assembly or disassembly, it is important to not apply a transverse load to the firing pin. If the firing pin is improperly loaded, the firing pin could be broken by a load applied somewhat perpendicular to the wide, flat face of the firing pin.

The two-piece construction, of the firing pin and the firing pin shaft, detailed herein accordingly provides an improvement in ease of assembly and replacement of damaged components without requiring replacement of the entire assembly. The replaceable firing pin assembly described herein further will not be prone to warping or twisting since the two-piece construction will operate as a one-piece unit when the spring retaining sleeve is oriented to hold the completed assembly securely in place. Since the firing pin head thus is substantially integrally connected or attached to the firing pin shaft, a good, smooth engagement operation with a round loaded in the chamber of the firearm is ensured, while avoiding creep or misalignment due to an incorrectly positioned firing pin head. In addition, the lock time of the firearm is improved over conventional two-piece firing pin designs. Further, since the firing pin can be stamped, metal injection molded or otherwise formed using more mass production techniques, the firing pin is easily manufactured and the shape of the firing pin tip is thus easily and cheaply reproduced by stamping or similar tools. In addition, the firing pin shaft is on the center line of the bore of the firearm such that the bore, bolt, receiver, and the barrel of the firearm are all concentrically oriented, which further simplifies machining and provides the basic platform for expansion or conversion of the firearm from a rim-fire design to a center-fire design.

The invention has been described herein in terms of preferred embodiments and methodologies that represent the best mode known to the inventors of carrying out the invention. It will be understood by those of skill in the art, however, that a wide variety of modifications, substitutions, and alternatives to the illustrated embodiments might be made without departing from the spirit and scope of the invention as set forth in the claims.

I claim:

1. A firing pin assembly comprising:

a firing pin and a firing pin shaft adapted to receive and seat the firing pin therein, the firing pin including an angled firing end;

a main spring sleeve received over the firing pin shaft;

a spring retaining sleeve mountable along the fixing pin shaft spaced from the main spring sleeve and engaging the firing pin; and a main spring housed between the main spring sleeve and the spring retaining sleeve;

whereby the firing pin is held in linked engagement with the firing pin shaft by the spring retaining sleeve, and wherein the spring retaining sleeve includes at least one side surface that engages retaining surfaces formed along the firing pin shaft.

2. The firing pin assembly of claim 1 wherein the main spring sleeve comprises a notched end and an unnotched end and wherein the firing pin shaft comprises a firing pin shaft head.

3. The firing pin assembly of claim 1 and wherein the firing pin comprises a stamped piece.

4. The firing pin assembly of claim 1 and wherein the firing pin includes a head portion adapted to be received and held within a slotted end of the firing pin shaft.

5. The firing pin assembly of claim 1 wherein the spring retaining sleeve has a slotted end with a slot.

6. The firing pin assembly of claim 5 wherein the spring retaining sleeve is rotatable around the firing pin shaft.

7. The firing pin assembly of claim 1, wherein the firing end of the firing pin comprises an angled surface having an angle of about 7 to about 8 degrees.

8. A firing pin assembly comprising:

a firing pin shaft having a notched end including a channel extending rearwardly therefrom, and at least one recess adjacent the notched end;

a firing pin having a retention end and a firing end, the retention end comprising a head portion projecting therefrom and removably received within the channel;

a main siring sleeve received over the firing pin shaft;

a spring retaining sleeve mountable along the firing pin shaft spaced from the main spring sleeve; and a main spring housed between the main spring sleeve and the spring retaining sleeve, wherein the notch of the firing pin is substantially aligned with the at least one recess in the firing pin, and wherein the spring retaining sleeve includes at least one inwardly directed side surface that engages the notch of the firing pin.

9. The firing pin assembly of claim 8, wherein the firing pin includes a top edge comprising a notch proximate the head portion.

10. The firing pin assembly of claim 8, wherein the firing end of the firing pin comprises an angled surface.

11. The firing pin assembly of claim 8, wherein the firing pin interchangeably is a centerfire pin or a rimfire pin.

12. A firing pin assembly comprising:

a firing pin shaft having a notched end including a channel extending rearwardly therefrom, and at least one recess adjacent the notched end; and a firing pin having a retention end and a firing end, the retention end comprising a head portion projecting therefrom and removably received within the channel, wherein the firing end of the firing pin comprises an angled surface having an angle of about 7 to about 8 degrees.

* * * * *